US007698760B2

(12) United States Patent
Reckelhoff et al.

(10) Patent No.: US 7,698,760 B2
(45) Date of Patent: Apr. 20, 2010

(54) HOSPITAL BED CASTER CONTROL SYSTEM

(75) Inventors: Jerome E. Reckelhoff, Blue Ash, OH (US); Christian H. Reinke, York, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 612 days.

(21) Appl. No.: 11/560,337

(22) Filed: Nov. 15, 2006

(65) Prior Publication Data

US 2008/0120810 A1 May 29, 2008

Related U.S. Application Data

(60) Provisional application No. 60/737,820, filed on Nov. 17, 2005, provisional application No. 60/803,841, filed on Jun. 2, 2006.

(51) Int. Cl.
*A61G 7/05* (2006.01)

(52) U.S. Cl. ..... 5/600; 5/86.1; 16/35 R

(58) Field of Classification Search ..... 5/86.1, 5/600, 620; 188/19, 20, 29; 16/35 R, 35 D
See application file for complete search history.

(56) References Cited

U.S. PATENT DOCUMENTS

| | | | |
|---|---|---|---|
| 3,055,042 A | | 9/1962 | Burzlaff |
| 4,276,962 A | | 7/1981 | Aulik |
| 4,309,791 A | | 1/1982 | Aulik |
| 4,439,879 A | | 4/1984 | Werner |
| 4,922,574 A | | 5/1990 | Heiligenthal et al. |
| 4,998,320 A | | 3/1991 | Lange |
| 5,377,372 A | * | 1/1995 | Rudolf et al. |
| 5,450,639 A | | 9/1995 | Weismiller et al. |
| 5,537,715 A | | 7/1996 | Yang |
| 5,774,936 A | | 7/1998 | Vetter |
| 5,806,111 A | | 9/1998 | Heimbrock et al. |
| 5,899,469 A | | 5/1999 | Pinto et al. |
| 5,937,440 A | | 8/1999 | Ferriter |
| 6,016,580 A | | 1/2000 | Heimbrock et al. |
| 6,089,593 A | | 7/2000 | Hanson et al. |
| 6,102,645 A | | 8/2000 | Kooima et al. |

(Continued)

FOREIGN PATENT DOCUMENTS

| | | |
|---|---|---|
| DE | 29510756 | 9/1995 |

(Continued)

OTHER PUBLICATIONS

European Search Report dated Jan. 12, 2009, for European Application EP06255891.

*Primary Examiner*—Jennifer H Gay
*Assistant Examiner*—Gilbert Y Lee
(74) *Attorney, Agent, or Firm*—Barnes & Thornburg LLP

(57) ABSTRACT

A patient support apparatus includes a base having a first side, a second side, a head end, and a foot end, a head end caster and a foot end caster coupled to the base on the first side near the respective head and foot ends, and a head end link and a foot end link located on the first side and operably associated with the respective head and foot end casters on the first side. The head and foot end links on the first side move longitudinally in opposite directions to brake the respective head and foot end casters on the first side.

27 Claims, 15 Drawing Sheets

U.S. PATENT DOCUMENTS

| | | | |
|---|---|---|---|
| 6,219,845 | B1 | 4/2001 | Ferriter |
| 6,240,579 | B1 | 6/2001 | Hanson et al. |
| 6,264,006 | B1 | 7/2001 | Hanson et al. |
| 6,286,165 | B1 | 9/2001 | Heimbrock et al. |
| 6,296,261 | B1 | 10/2001 | deGoma |
| 6,314,597 | B2 | 11/2001 | Heimbrock et al. |
| 6,315,319 | B1 | 11/2001 | Hanson et al. |
| 6,321,878 | B1 | 11/2001 | Mobley et al. |
| 6,351,861 | B1 | 3/2002 | Shows et al. |
| 6,405,393 | B2 | 6/2002 | Megown |
| 6,473,921 | B2 | 11/2002 | Brooke et al. |
| 6,505,359 | B2 | 1/2003 | Heimbrock et al. |
| 6,565,112 | B2 | 5/2003 | Hanson et al. |
| 6,575,052 | B2 | 6/2003 | Toennesland et al. |
| 6,643,873 | B2 | 11/2003 | Heimbrock et al. |
| 6,668,402 | B2 | 12/2003 | Heimbrock |
| 6,684,420 | B2 | 2/2004 | Koenig et al. |
| 6,725,501 | B2 | 4/2004 | Harris et al. |
| 6,728,984 | B2 | 5/2004 | Dietrich |
| 6,772,460 | B2 | 8/2004 | Heimbrock |
| 6,829,793 | B2 | 12/2004 | Brooke et al. |
| 6,839,926 | B2 | 1/2005 | Heimbrock et al. |
| 6,843,349 | B2 | 1/2005 | Walsh et al. |
| 6,846,042 | B2 | 1/2005 | Hanson et al. |
| 6,865,775 | B2 | 3/2005 | Ganance |
| 6,902,019 | B2 | 6/2005 | Heimbrock et al. |
| 6,938,301 | B2 | 9/2005 | Brooke et al. |
| 6,951,034 | B2 | 10/2005 | Shiery et al. |
| 7,140,055 | B2 | 11/2006 | Bishop et al. |
| 7,200,894 | B2 | 4/2007 | Block et al. |
| 7,302,717 | B2 | 12/2007 | Reinke et al. |
| 7,346,942 | B2 | 3/2008 | Reinke et al. |
| 7,353,566 | B2 | 4/2008 | Scheiber et al. |

FOREIGN PATENT DOCUMENTS

| | | |
|---|---|---|
| EP | 0618088 | 10/1994 |
| EP | 1084931 | 3/2001 |
| NL | 6806414 | 11/1969 |

* cited by examiner

HOSPITAL BED CASTER CONTROL SYSTEM

CROSS REFERENCE TO RELATED APPLICATIONS

This application claims the benefit of a U.S. Provisional Patent Application Ser. No. 60/737,820, filed on Nov. 17, 2005, and entitled "Birthing Bed Foot Section" and a U.S. Provisional Patent Application Ser. No. 60/803,841, filed on Jun. 2, 2006, and entitled "Ob/Gyn Bed," each of the foregoing provisional applications being hereby incorporated by reference herein.

BACKGROUND OF THE INVENTION

The present disclosure relates generally to a patient support apparatus, such as a hospital bed, having casters. More particularly, the present disclosure relates to an apparatus for controlling the brakes which engage the caster wheels supporting the patient support apparatus.

Hospital beds are provided with casters mounted around the base for rolling the bed from place to place. At least one of the casters, and usually two, have at least two operating modes, namely, neutral and brake modes. Also, one of the casters has all three operating modes, namely, neutral, brake and steer modes. In the neutral mode, the caster wheel is free to swivel and rotate. In the brake mode, a brake pad is pressed against the surface of the caster wheel to prevent it from rotating and swiveling. In the steer mode, the caster wheel is locked against swiveling movement, but is free to rotate. In addition, in the steer mode, the caster wheel is aligned parallel to a longitudinal dimension of the bed so that the bed can be pushed straight down a hallway without the bed drifting to one side or the other. An illustrative caster braking system is disclosed in U.S. Pat. No. 5,377,372, which is hereby incorporated by reference herein.

SUMMARY OF THE INVENTION

The present invention comprises an apparatus or a system that has one or more of the following features or combinations thereof, which alone or in any combination may comprise patentable subject matter.

A patient support apparatus may comprise a base having a first side, a second side, a head end, and a foot end, a head end caster and a foot end caster coupled to the base on the first side near the respective head and foot ends, and a head end link and a foot end link located on the first side and operably associated with the respective head and foot end casters on the first side. The head and foot end links on the first side may be arranged to move longitudinally in opposite directions to brake the respective head and foot end casters on the first side.

The apparatus may further include a shaft pivotably mounted to the base and a linkage coupling the shaft to the head and foot end links. The shaft may carry a pedal lever having a brake pedal. Depression of the brake pedal may cause the linkage to brake the two casters. The apparatus may include a pin secured to the shaft and a rotational stop secured to the base. The pin may engage the rotational stop to limit the rotation of the shaft in a braking direction in response to the depression of the brake pedal.

In some embodiments, the casters may each have a neutral mode and a brake mode. The pedal lever may include brake and steer pedals on the opposite sides thereof. The pedal lever may be disposed in a generally horizontal position when the two casters are in their respective neutral modes. Depression of the brake pedal beyond its generally horizontal position may cause the linkage to position the two casters in their respective brake modes. When the brake pedal is depressed beyond its generally horizontal position, the steer pedal may be used to return the brake pedal to its horizontal position to, in turn, position the two casters in their respective neutral modes.

In some embodiments, one of the two casters may be a brake-steer caster having neutral, brake and steer modes and the other of the two casters may be a brake caster having neutral and brake modes. Depression of the brake pedal beyond its generally horizontal position may cause the linkage to position the two casters in their respective brake modes, and depression of the steer pedal beyond its generally horizontal position may cause the linkage to position the brake-steer caster in the steer mode while allowing the brake caster to remain in the neutral mode.

The apparatus may include a pin secured to the shaft and first and second rotational stops secured to the base. The pin may engage the first rotational stop to limit the rotation of the shaft in a braking direction in response to the depression of the brake pedal and the pin may engage the second rotational stop to limit the rotation of the shaft in a steering direction in response to the depression of the steer pedal.

The base may have a first longitudinal rail on the first side, a second longitudinal rail on the second side and a cross beam interconnecting the two rails. The two links on the first side may be located within an interior region of the first rail, and the shaft may be located within an interior region of the cross beam. In some embodiments, the linkage may include a cam mounted on the shaft for rotation therewith and head and foot end cam plates configured to operatively engage the cam. The cam and the cam plates may be located within the interior region of the first rail. The head and foot end cam plates may be coupled to the respective head and foot end links so that depression of the brake pedal may cause the cam to move the two cam plates in opposite directions to, in turn, move the two links in opposite directions to brake the two casters.

The linkage may include a bead end rocker arm pivotally coupled to the first rail near the head end and a foot end rocker arm pivotally coupled to the first rail near the foot end. A first end of the head end rocker arm may be adapted to actuate the head end caster. A second end of the head end rocker arm may be coupled to a first end of the head end link. A second end of the head end link may be coupled to the head end cam plate. A first end of the foot end rocker arm may be adapted to actuate the foot end caster. A second end of the foot end rocker arm may be coupled to a first end of the foot end link. A second end of the foot end link may be coupled to the foot end cam plate.

In some embodiments, the linkage may include a detent mechanism operable to resist the rotation of the shaft when the shaft is in angular positions that correspond to the neutral, brake and steer modes of the brake-steer caster. The detent mechanism may include a block coupled to the base and having a bore to rotatably support the shaft, a plunger slidably mounted in the block and biased forward so as to project into the bore, and a plurality of recesses around the circumference of the shaft. Each of the recesses may correspond to one of the neutral, brake and steer modes of the brake-steer caster.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
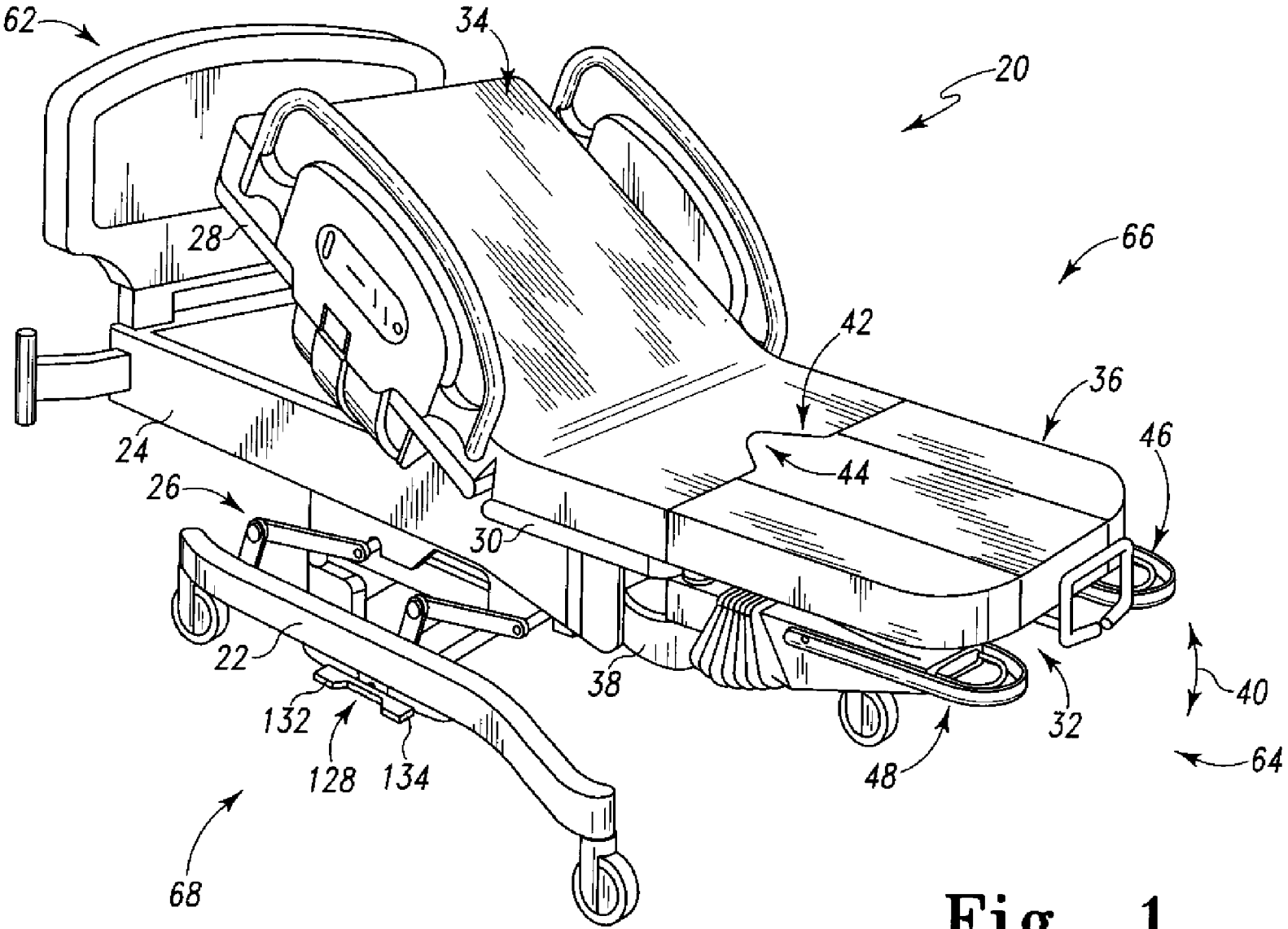
FIG. 1 is a perspective view of an illustrative birthing bed showing a base frame supported on casters which have a plurality of operating modes, an intermediate frame supported above the base by a parallelogram linkage, head, seat and foot deck sections supported by the intermediate frame, an upper mattress supported on the head and seat deck sections, a leg support mattress supported on the foot deck section, and a pair of side rails mounted on opposite sides of the head deck section.

As shown in FIG. 1, an illustrative birthing bed 20 includes a base frame 22 supported on casters 72, 74, 82, 84, an intermediate frame 24 supported above the base frame 22 by a parallelogram linkage 26, head, seat and foot deck sections 28, 30, 32 supported by the intermediate frame 24, an upper mattress 34 supported on the head and seat deck sections 28, 30, a leg support mattress 36 supported on the foot deck section 32, and a pair of side rails mounted on opposite sides of the head deck section 28. The head and seat deck sections 28, 30 are articulatable relative to the intermediate frame 24. The foot deck section 32 is releasably secured to a yoke 38 that is, in turn, supported by the intermediate frame 24. The yoke 38 moves vertically as depicted by arrow 40 in FIG. 1 to adjust to a plurality of positions including positions in which the foot deck section 32 is vertically spaced from the seat deck section 30. This allows a caregiver to adjust the birthing bed 20 to a plurality of positions during labor and delivery.

The upper mattress 34 has a v-shaped cavity 42 along the edge of the upper mattress 34 adjacent the foot deck section 32. The leg support mattress 36 has a protrusion 44 that is configured to be received in the cavity 42 to form a continuous support surface for a patient when the foot deck section 32 is vertically aligned with the seat deck section 30. The birthing bed 20 also comprises two articulatable foot supports 46 and 48. Foot support 46 is positioned to support a patient's left foot when in use while foot support 48 is positioned to support a patient's right foot when in use. An illustrative bed of this type is described in detail in U.S. patent application Ser. No. 11/560,335, entitled "Stowing Birthing Bed Foot Section," and filed concurrently herewith, which is hereby incorporated by reference herein.

Figure 2:
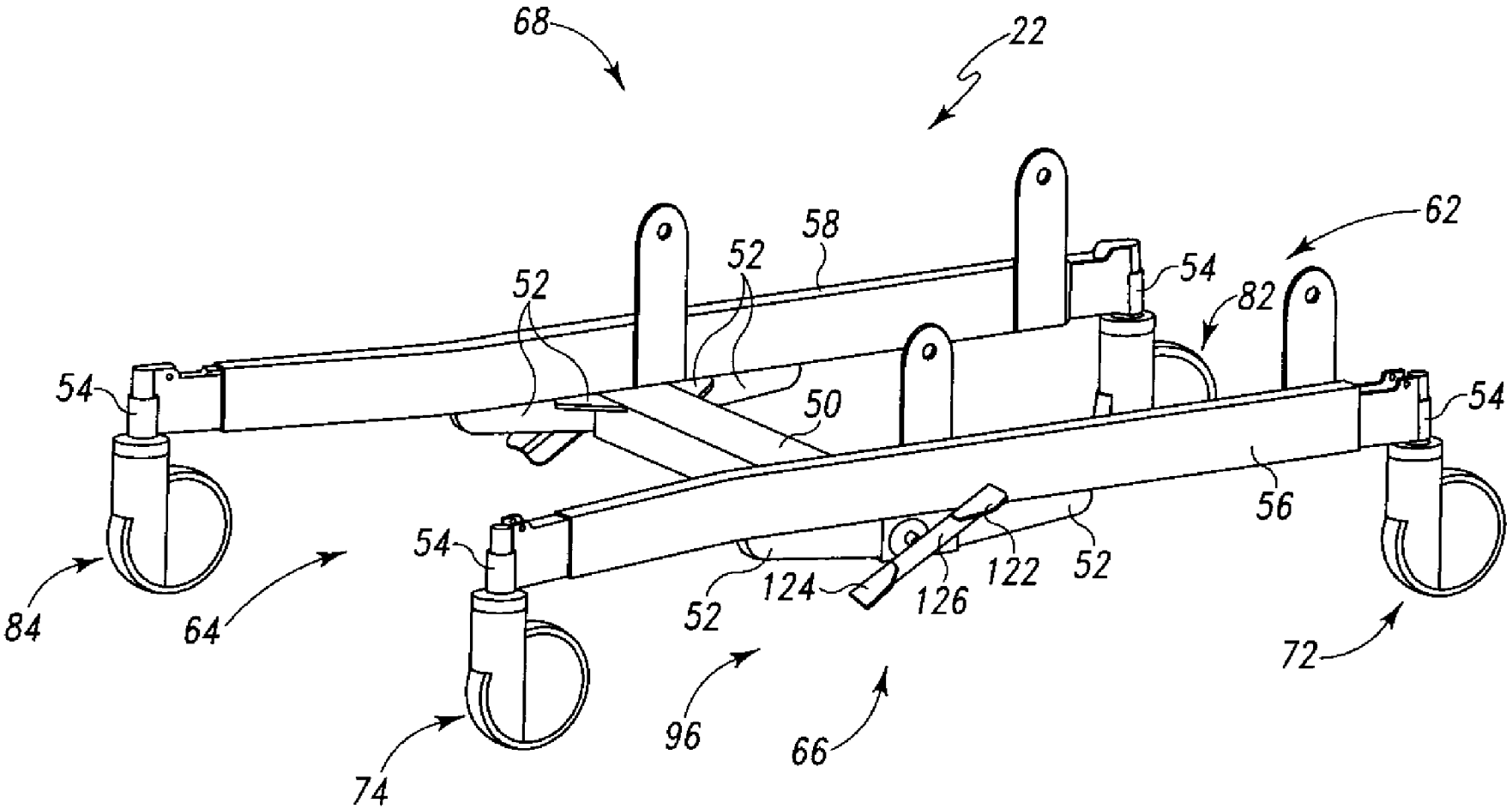
FIG. 2 is a perspective view, with portions omitted, of the base frame showing the base frame including a cross beam interconnecting a pair of longitudinally-extending rails, a caster coupled to each end of each rail, and showing a brake-steer linkage coupled to the base frame and operable to selectively position the casters in one of the plurality of operating modes.
Figure 3:
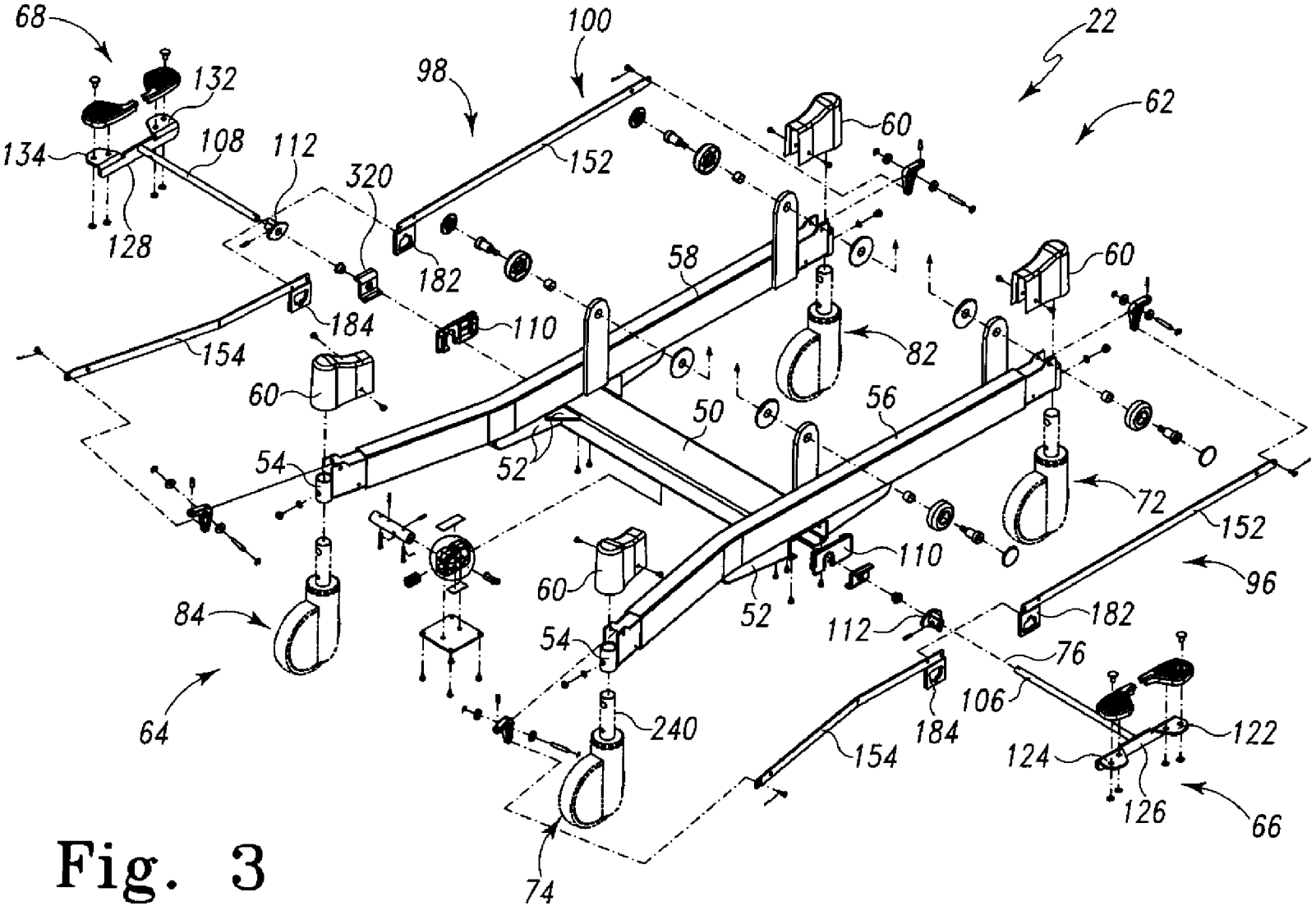
FIG. 3 is an exploded perspective view showing the base frame and the brake-steer linkage.
Figure 4:
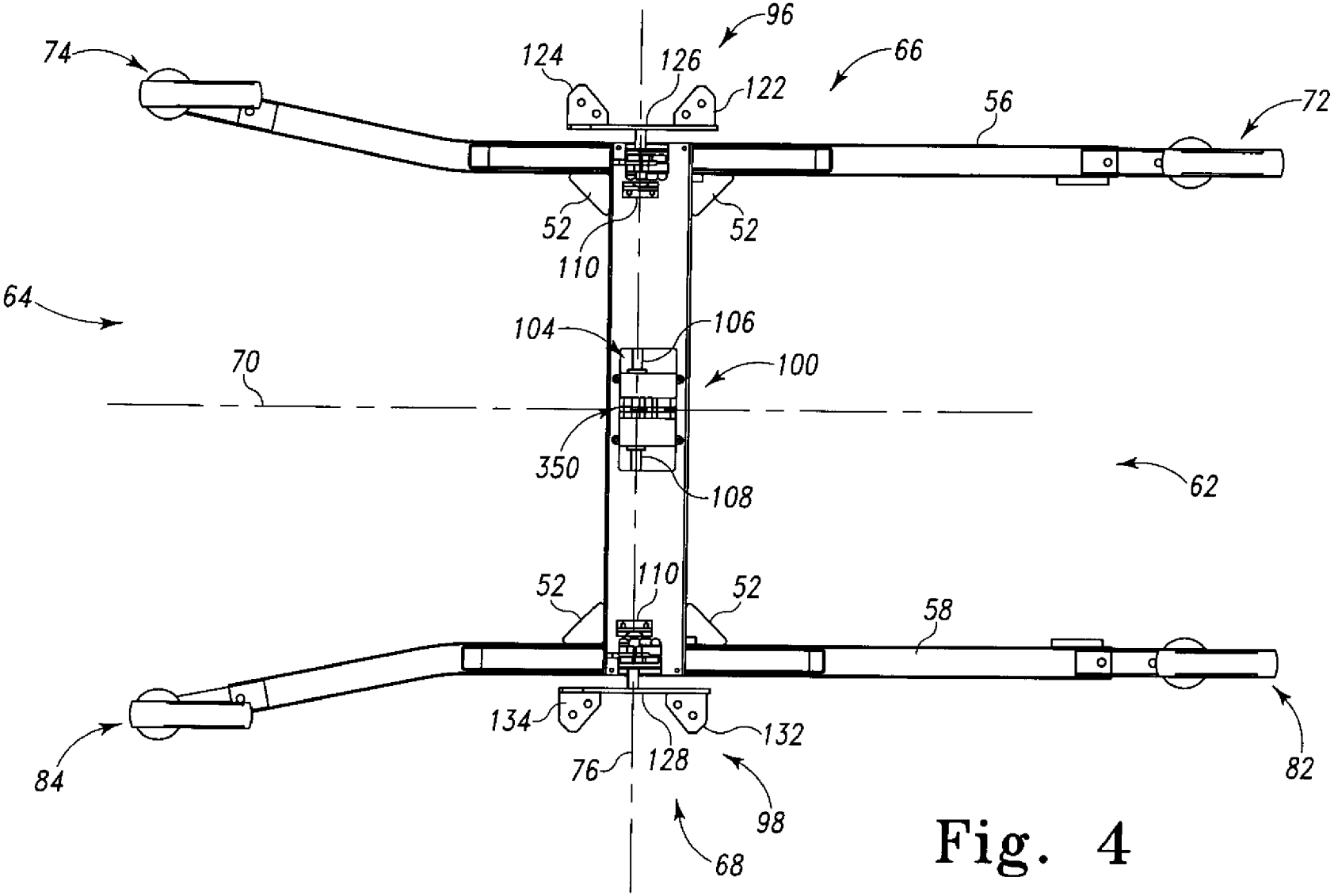
FIG. 4 is a bottom view of the base frame.

Referring to FIGS. 2-4, the base frame 22 has a cross beam 50 interconnecting a pair of longitudinal rails 56, 58, a head end 62, a foot end 64, a left side 66, a right side 68, a longitudinal axis 70 (FIG. 4), and a lateral axis 76 (FIG. 4). The cross beam 50 is a primary structural element tying the longitudinal rails 56, 58 together to form the base frame 22. The base frame 22 includes corner brackets or gussets 52 interconnecting the cross beam 50 with the longitudinal rails 56, 58. The longitudinal rails 56, 58 are flared outwardly toward the foot end 64 as shown in FIGS. 2-4. In the illustrated embodiment, the cross beam 50 and the longitudinal rails 56, 58 are in the form of extruded tubular members having a generally rectangular cross section, and are made from rigid high strength, light weight materials, such as steel or aluminum. As shown in FIG. 3, each of the casters 72, 74, 82, 84 is mounted within a socket 54 at each end 62, 64 of each rail 56, 58. Each socket 54 is covered by an end cap 60 to shield internal mechanisms.

As used in this description, the phrase "head end 62" will be used to denote the end of any referred-to object that is positioned to lie nearest the head end 62, and the phrase "foot end 64" will be used to denote the end of any referred-to object that is positioned to lie nearest the foot end 64. Likewise, the phrase "left side 66" will be used to denote the side of any referred-to object that is positioned to lie nearest the left side 66, and the phrase "right side 68" will be used to denote the side of any referred-to object that is positioned to lie nearest the right side 68. The words "inwardly" and "outwardly" will refer to directions toward and away from, respectively, the geometric center of any referred-to object, such as the base frame, to which the reference is made.

In the illustrated embodiment, the casters 72, 74, 82, 84 have a plurality of operating modes. For example, the caster 74, which is located near the foot end 64 on the left side 66 of the base frame 22, is a plunger-type caster having neutral, brake and steer modes (shown respectively in FIGS. 14-16), while the three remaining casters 72, 82, 84 are plunger-type casters having only neutral and brake modes. It is known to use the term "neutral-brake-steer" caster interchangeably with the term "brake-steer" caster, as well as to use the term "neutral-brake" caster interchangeably with the term "brake" caster. Thus, in the illustrated embodiment, the caster 74, which is located near the foot end 64 on the left side 66 of the base frame 22 is a brake-steer caster, while the remaining three casters 72, 82, 84 are brake casters. It will, however, be appreciated that the bed 20 could be provided with a different combination of brake casters, brake-steer casters, and conventional casters (without either the brake mode or the steer mode). For example, the bed 20 may very well be provided with one brake-steer caster near the foot end 64 on the left side 66, one brake caster near the head end 62 on the right side 68, and two conventional casters.

As shown in FIGS. 3-4, the bed 20 includes a brake-steer linkage 100, some components of which are housed within the tubular base frame 22. The brake-steer linkage 100 is operable to selectively position the brake-steer caster 74 in the neutral, brake and steer modes, and the three brake casters 72, 82, 84 in the neutral and brake modes. In the illustrated embodiment, the linkage 100 is symmetrical on the left and right sides 66, 68 of the bed 20 as shown in FIG. 3. The portion 96 of the linkage 100 on the left side 66 controls the casters 72, 74 on the left side 66, while the portion 98 of the linkage 100 on the right side 68 controls the casters 82, 84 on the right side 68.

Figure 12:
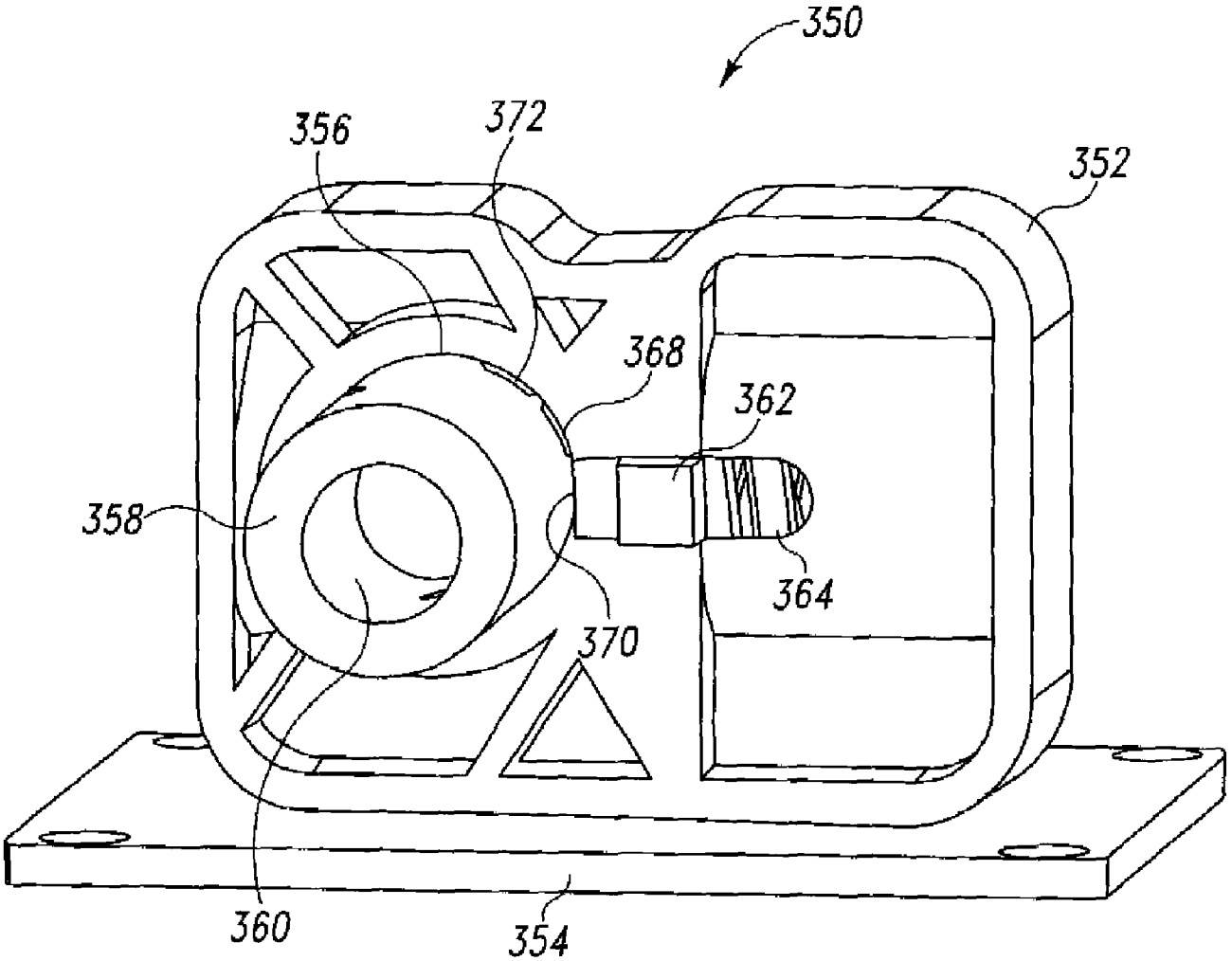
FIG. 12 is a perspective view of the detent mechanism.
Figure 13:
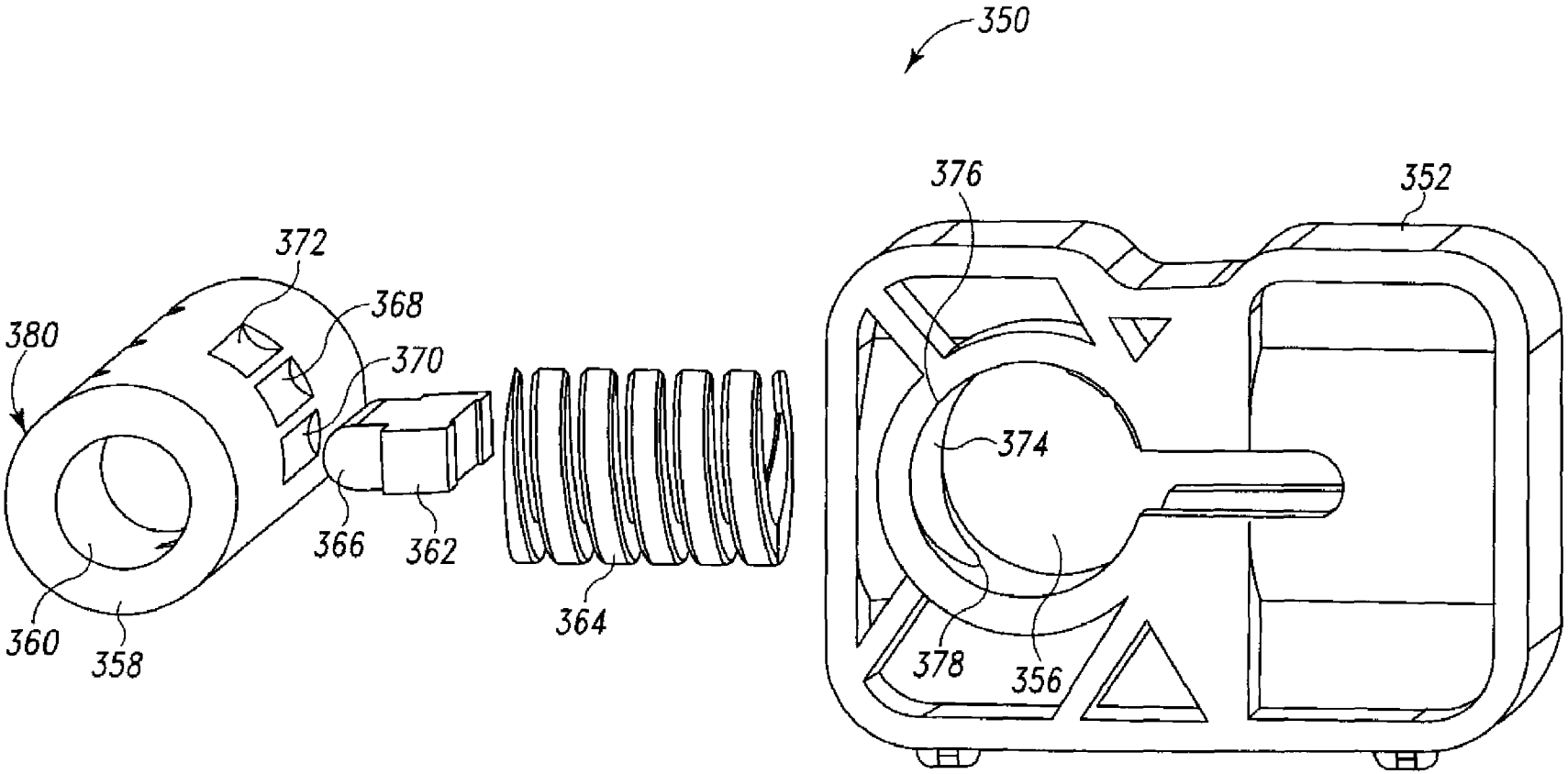
FIG. 13 is an exploded perspective view of the detent mechanism.

The linkage 100 comprises a two-piece shaft 104 (FIG. 4) made up of shaft halves 106, 108, which extend toward the left and right sides 66, 68, respectively. The innermost ends of the shaft halves 106, 108 are coupled to a collar 358 (FIGS. 12-13). An outer end of each shaft half 106, 108 is rotatably supported in a bracket 110 (FIGS. 3-4). Outboard of the bracket 110, each shaft half 106, 108 includes a cam 112 (shown in FIGS. 9-11) mounted thereon for rotation therewith. A pedal lever 126, 128 is connected to the outermost end of each shaft half 106, 108. In the illustrated embodiment, the two shaft halves 106, 108, the two brackets 110 supporting the respective shaft halves 106, 108 and the two cams 112 mounted on the respective shaft halves 106, 108 are all mounted within the tubular cross beam 50.

Referring to FIGS. 2-8, the pedal lever 126 on the left side 66 of the bed 20 includes a steer pedal 122 adjacent the head end 62 and a brake pedal 124 adjacent the foot end 64. The pedal lever 128 on the right side 68 of the bed 20 includes a steer pedal 132 adjacent the head end 62 and a brake pedal 134 adjacent the foot end 64. Both pedal levers 126, 128 have a generally horizontal position when all four casters 72, 74, 82, 84 are in their respective neutral modes. Downward actuation of either brake pedal 124, 134 beyond the generally horizontal position of the associated pedal lever 126, 128 causes the linkage 100 to position all four casters 72, 74, 82, 84 in their respective brake modes. On the other hand, downward actuation of either steer pedal 122, 132 beyond the generally horizontal position of the associated pedal lever 126, 128 causes the linkage 100 to position the brake-steer caster 74 in the steer mode, while allowing the remaining three brake casters 72, 82, 84 to remain in the neutral mode.

When the brake pedals 124, 134 are in their respective brake positions, either one of the steer pedals 122, 132 may be used to return the pedal levers 126, 128 to their respective horizontal positions to, in turn, position all four casters 72, 74, 82, 84 in their respective neutral modes. On the other hand, when the steer pedals 124, 134 are in their respective steer positions, either one of the brake pedals 124, 134 may be used to return the pedal levers 126, 128 to their respective horizontal positions to, in turn, position all four casters 72, 74, 82, 84 in their respective neutral modes.

Figure 5:
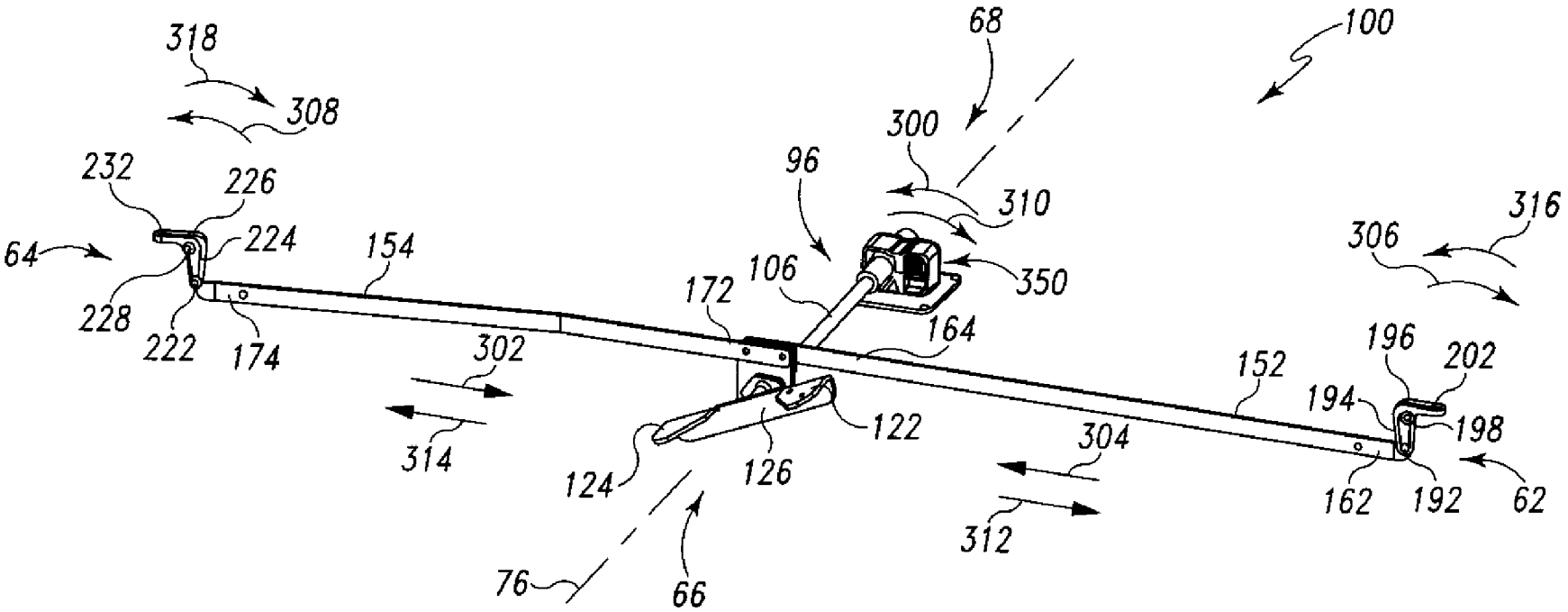
FIG. 5 is a perspective view of a portion of the brake-steer linkage on the left side of the bed showing a brake-steer shaft extending outwardly from a detent mechanism, a cam mounted on the brake-steer shaft, a brake-steer pedal coupled to the brake-steer shaft outboard of the cam, a head end cam plate coupled to a head end link extending toward a head end of the bed, a foot end cam plate coupled to a foot end link extending toward a foot end of the bed, and head and foot end rocker arms coupled to the respective head and foot end links.
Figure 6:
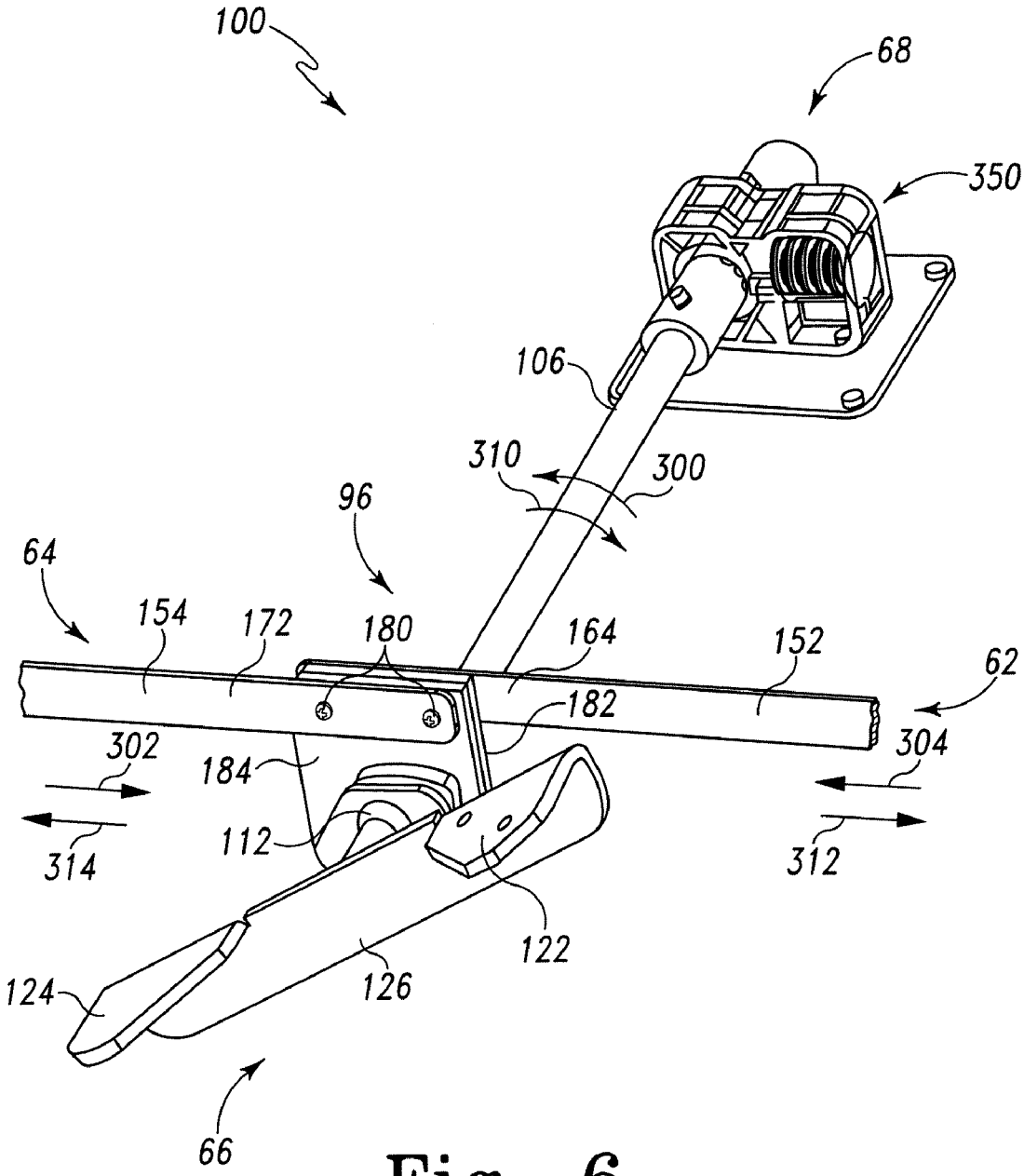
FIG. 6 is an enlarged perspective view showing the detent mechanism, the brake-steer shaft, the cam mounted on the brake-steer shaft, the brake-steer pedal outboard of the cam, the head end cam plate coupled to the head end link extending toward the head end, and the foot end cam plate coupled to the foot end link extending toward the foot end.
Figure 7:
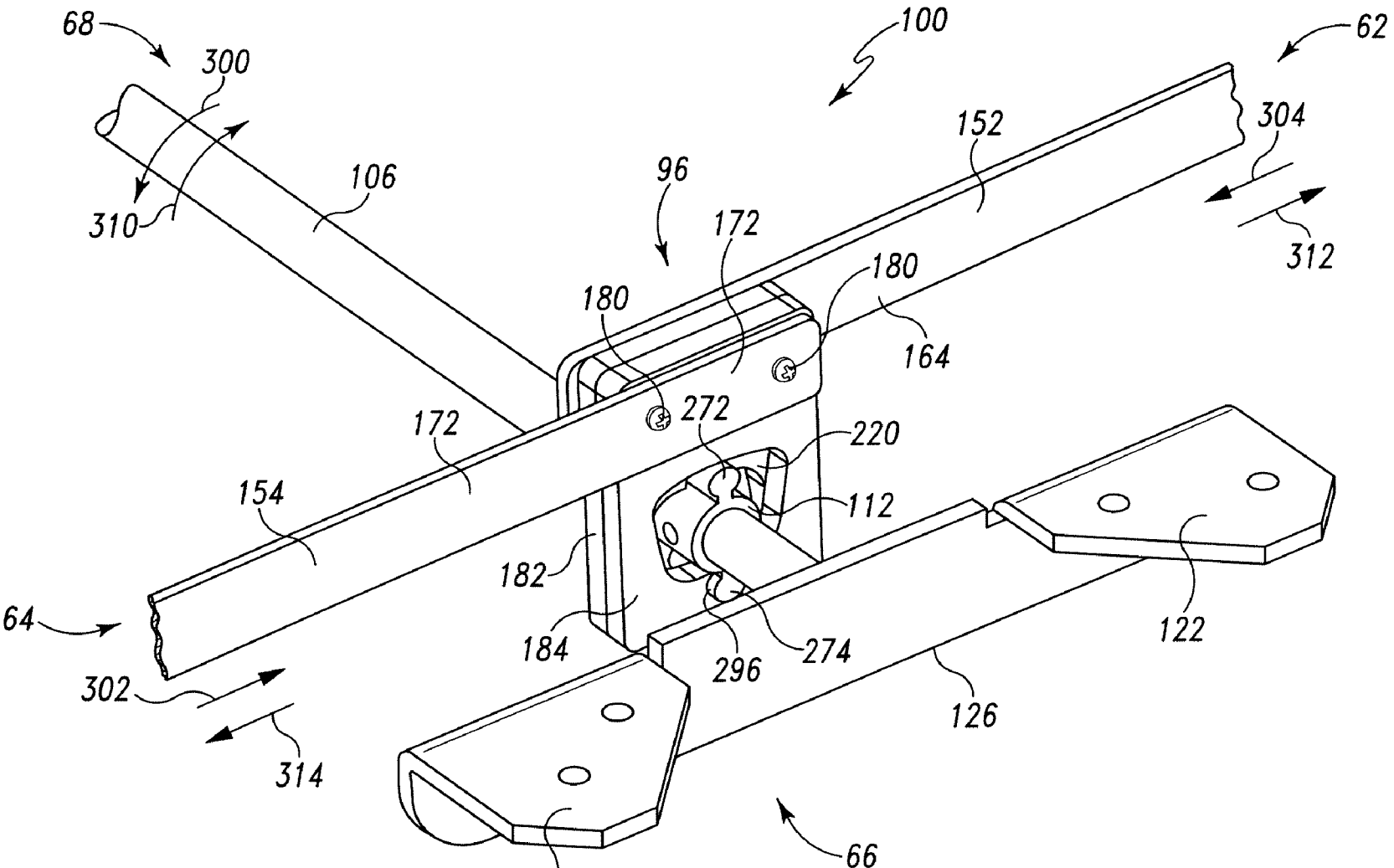
FIG. 7 is an enlarged perspective view from the left side of the bed showing a portion of the brake-steer shaft, the cam mounted on the brake-steer shaft, the brake-steer pedal outboard of the cam, the head end cam plate coupled to the head end link, the foot end cam plate coupled to the foot end link, a bottom lobe of the cam received in an upwardly-facing notch in the foot end cam plate.
Figure 8:
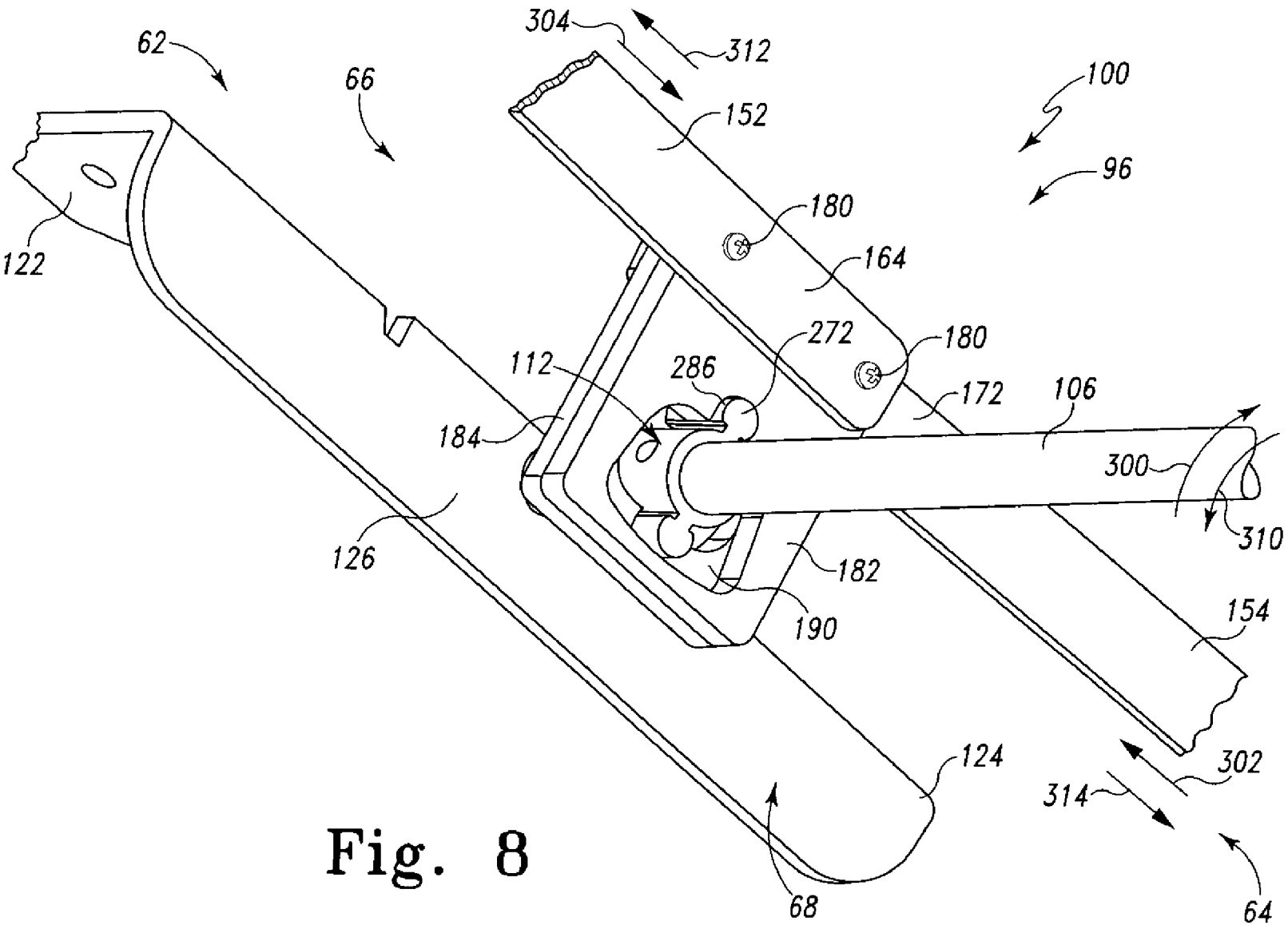
FIG. 8 is an enlarged perspective view similar to FIG. 7, but from a right side of the bed, showing a top lobe of the cam received in a downwardly-facing notch in the head end cam plate.
Figure 9:
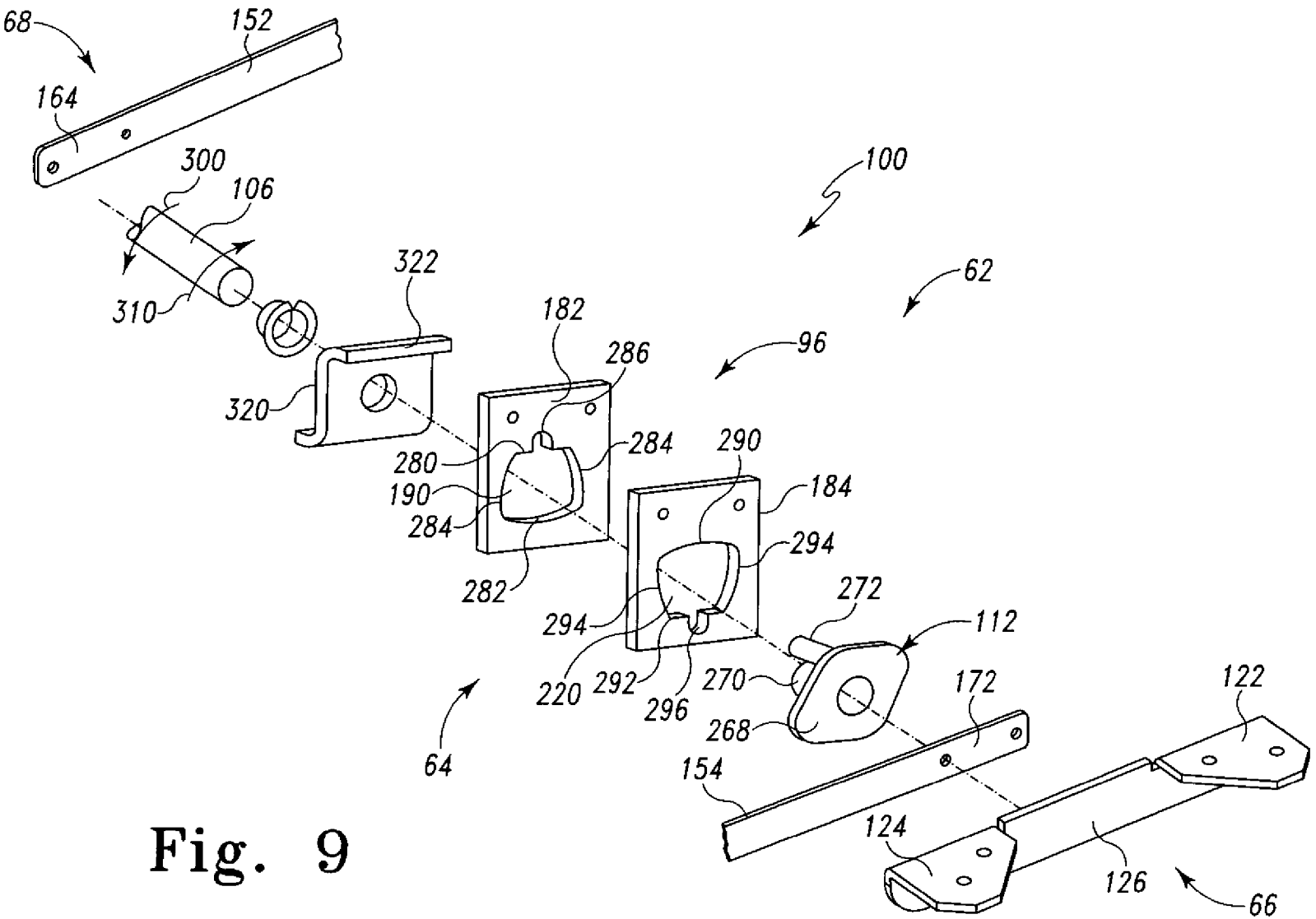
FIG. 9 is an exploded perspective view of the left hand portion of the brake-steer linkage.
Figure 10:
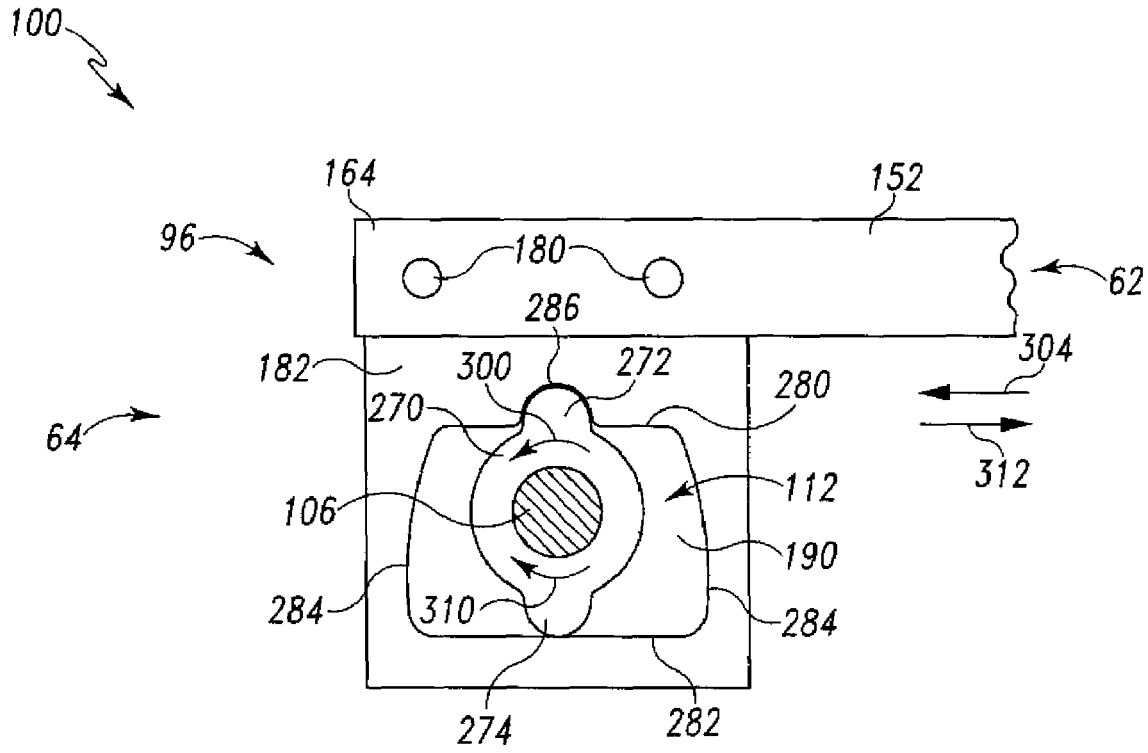
FIG. 10 is a side elevation view, with portions omitted, diagrammatically showing the head end cam plate coupled to the head end link extending toward the head end, and the cam having an upwardly-extending lobe received in a downwardly-facing notch in the head end cam plate.
Figure 11:
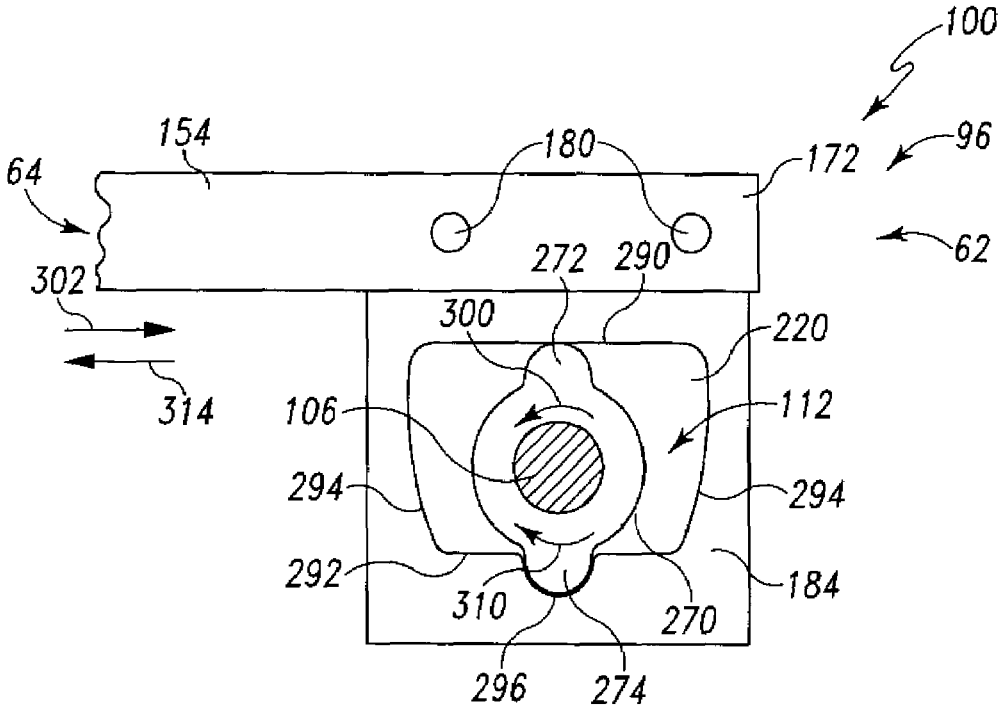
FIG. 11 is a side elevation view, with portions omitted, similar to FIG. 10, but diagrammatically showing the cam having a downwardly-extending lobe received in an upwardly-facing notch in the foot end cam plate.

FIGS. 5-11 show the left hand portion 96 of the brake-steer linkage 100. As shown in FIG. 3, the right hand portion 98 of the brake-steer linkage 100 is a mirror image of the left hand portion 96. The linkage 100 includes head and foot end links 152, 154 extending toward the respective head and foot ends 62, 64 of the base frame 22. The head and foot end links 152, 154 on the left side 66 of the bed 20 are mounted within the tubular longitudinal rail 56 on the left side 66 of the bed 20. Likewise, the head and foot end links 152, 154 on the right side 68 of the bed 20 are mounted within the tubular longitudinal rail 58 on the right side 68 of the bed 20. As shown in FIG. 3, the foot end links 154 flare outwardly toward the foot end 64 of the base frame 22 in the same manner as the longitudinal rails 56, 58 flare outwardly toward the foot end 64 of the base frame 22. As shown in FIGS. 6-8, a foot end 164 of the head end link 152 is connected to a head end cam plate 182 with suitable fasteners 180, such as screws, rivets, etc. As shown in FIG. 9, which is a view from the right side 68 of the base frame 22, the bead end cam plate 182 is located inboard of a foot end cam plate 184. As shown in FIG. 10, the head end cam plate 182 includes a cutout 190 therein for receiving the cam 112 mounted on the shaft half 106.

Figure 14:
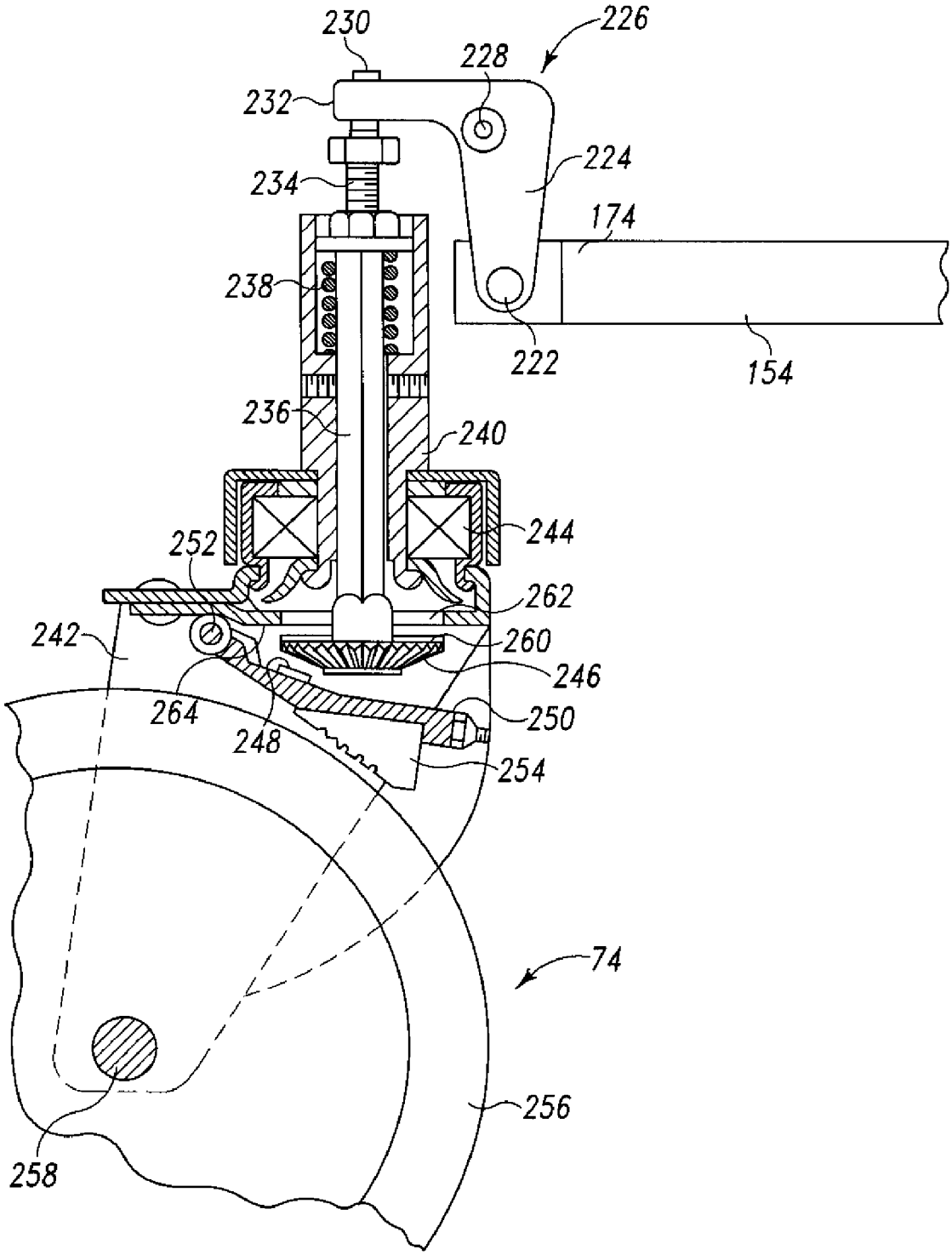
FIG. 14 is a side elevation view, in partial cross-section, of the brake-steer caster near the foot end and on the left side of the bed, with the brake-steer caster in a neutral mode.
Figure 15:
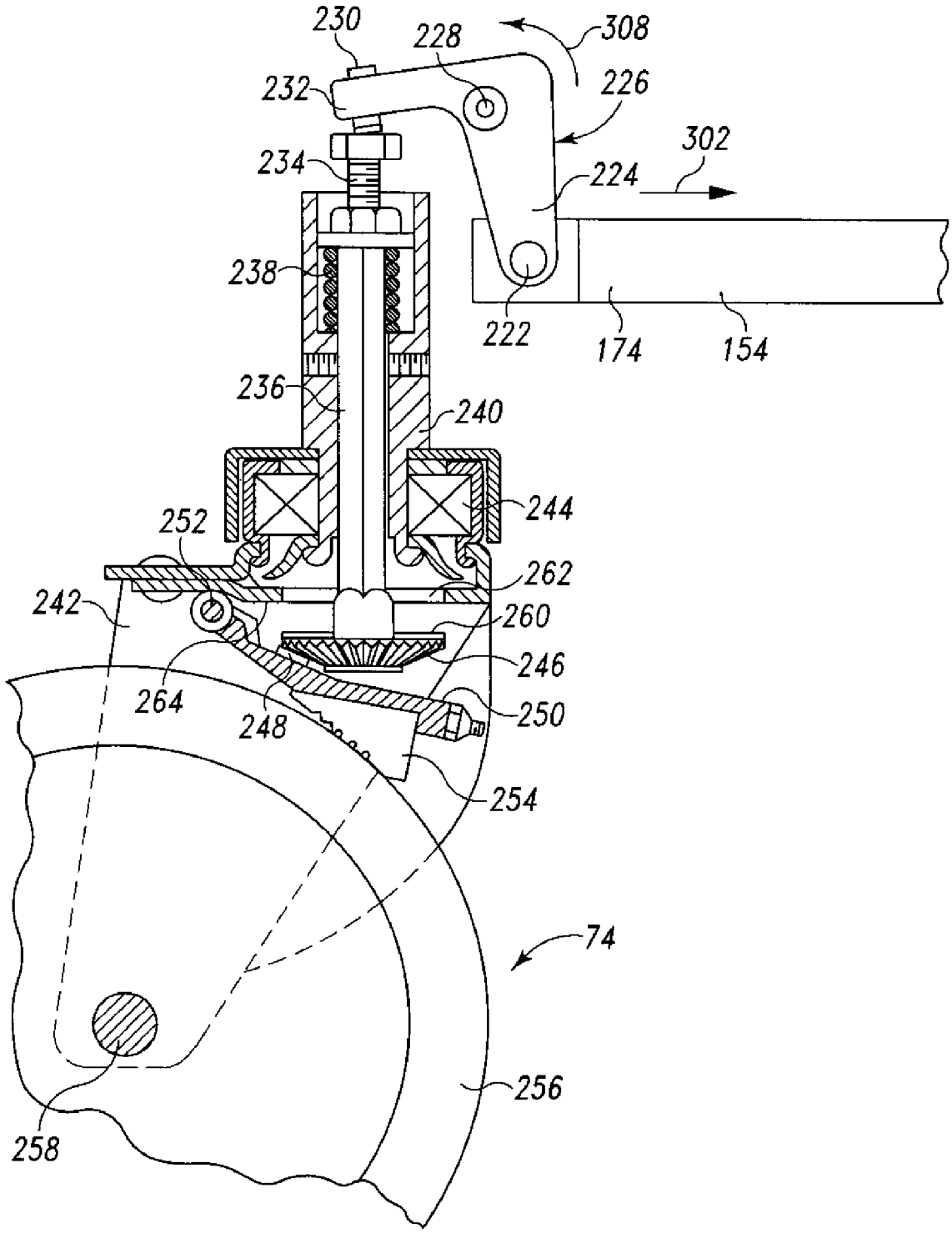
FIG. 15 is a view similar to FIG. 14, but with the brake-steer caster in a brake mode.
Figure 16:
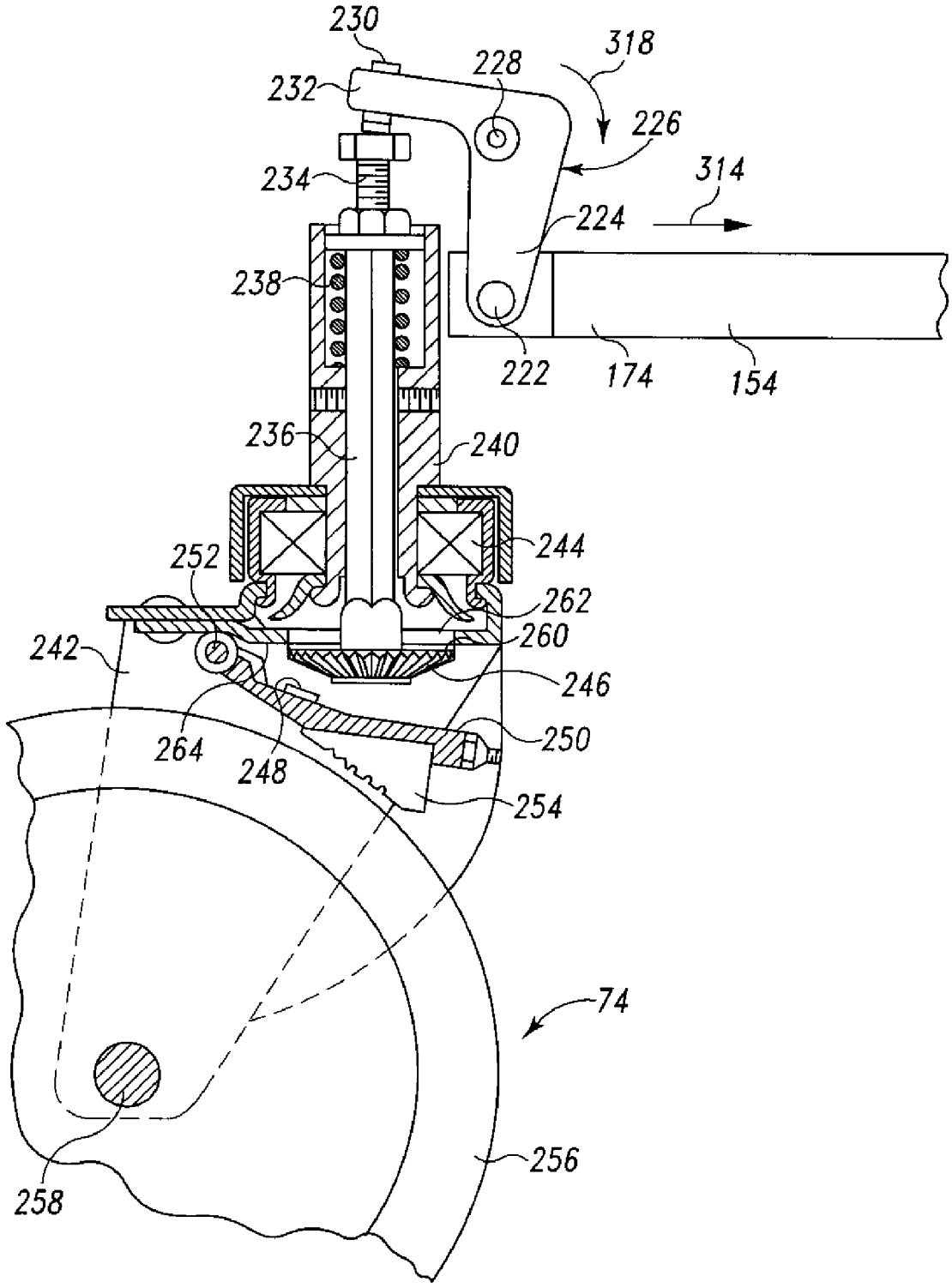
FIG. 16 is a view similar to FIG. 14, but with the brake-steer caster in a steer mode.

As shown in FIG. 5, a head end 162 of the head end link 152 on the left side 66 of the bed 20 has pivotally connected thereto at 192 a proximal end 194 of a rocker arm 196 (similar to the rocker arm 226 in FIGS. 14-16). The rocker arm 196 is pivoted at 198 to the longitudinal rail 56 near the head end 62 of the rail 56. An adjusting screw (similar to the adjusting screw 230 in FIGS. 14-16) is threaded into a distal end 202 of the rocker arm 196 for contacting an adjusting screw of a plunger of the associated brake caster 72 (similar to the plunger 236 of the brake-steer caster 74 in FIGS. 14-16). The plunger of the brake caster 72 is spring loaded upwardly with a compression spring (similar to the compression spring 238 in FIGS. 14-16).

As shown in FIGS. 6-8, a head end 172 of the foot end link 154 is connected to the foot end cam plate 184 with suitable fasteners 180, such as screws, rivets, etc. As shown in FIG. 9, the foot end cam plate 184 is located outboard of the head end cam plate 182. As shown in FIG. 11, the cam plate 184 includes a cutout 220 therein for receiving the cam 112 mounted on the shaft half 106. As shown in FIGS. 5 and 14-16, a foot end 174 of the foot end link 154 has pivotally connected thereto at 222 a proximal end 224 of a rocker arm 226. The rocker arm 226 is pivoted at 228 to the longitudinal rail 56 near the foot end 64 of the rail 56. An adjusting screw 230 is threaded into a distal end 232 of the rocker arm 226 for contacting an adjusting screw 234 of a plunger 236 of the associated brake-steer caster 74.

As shown in FIGS. 14-16, the brake-steer caster 74 includes a plunger housing 240 and a wheel yoke 242 mounted for swiveling movement with respect to the plunger housing 240 via a bearing 244. As shown in FIG. 3, the plunger housing 240 is, in turn, received in the socket 54 mounted to the foot end 64 of the longitudinal rail 56. The plunger 236 is spring loaded upwardly by a compression spring 238. On the lower end of the plunger 236 is a downwardly-facing bevel gear 246. In the brake mode, the downwardly-facing bevel gear 246 is configured to engage an upwardly-facing tooth 248 provided on a brake pad lever arm 250 as shown in FIG. 15. The brake pad lever arm 250 is pivoted to the wheel yoke 242 at 252. A brake pad 254 is mounted on the underside of the brake pad lever arm 250.

With the plunger 236 in the position shown in FIG. 14, the brake-steer caster 74 is said to be in its neutral mode which means that the caster yoke 242 may swivel freely with respect to the plunger housing 240 and the caster wheel 256 may rotate freely about its axis 258. With the plunger 236 in the position shown in FIG. 15, the brake-steer caster 74 is said to be in its brake mode which means that the caster yoke 242 is prevented from swiveling with respect to the plunger housing 240 and the caster wheel 256 is prevented from rotating about its axis 258. As shown in FIG. 15, in the brake mode, the downwardly-facing bevel gear 246 engages the upwardly-facing tooth 248 and, in addition, the brake pad 254 is pressed against the caster wheel 256.

With the plunger 236 in the position shown in FIG. 16, the brake-steer caster 74 is said to be in its steer mode which means that the caster yoke 242 is prevented from swiveling with respect to the plunger housing 240, but is aligned with the longitudinal axis 70 of the bed 20 to allow a caregiver to push the bed 20 in a straight line down a hallway without the bed 20 drifting to either side. In addition, in the steer mode, the caster wheel 256 is free to rotate about its axis 258. In the steer mode, as shown in FIG. 16, a rib 260 on an upperside of the bevel gear 246 is received in a downwardly-facing slot 262 in a plate 264 secured to the yoke 242. In the illustrated embodiment, the brake-steer caster 74 is of the type manufactured by Tente Casters, Inc., Hebron, Ky. 41048, having a part number 2444 UAP 150 R05.

The remaining three casters 72, 82, 84 are brake casters. The brake casters 72, 82, 84 are similar to the brake-steer caster 74 with one difference. The brake casters 72, 82, 84 do not have a steer mode. The three brake casters 72, 82, 84 are moved into and out of their respective neutral and brake modes in the same manner as the brake-steer caster 74 is moved into and out of its neutral and brake modes. When the plunger of a brake caster 72, 82, 84 is in its upwardmost position (in the manner shown in FIG. 16), the caster wheel yoke is still free to swivel with respect to the plunger housing. This is so because the brake casters 72, 82, 84 do not have a plate with a slot therein (similar to the plate 264 with the slot 262 in FIG. 16) in which to capture a rib on an upperside of a bevel gear (similar to the rib 260 on the upperside the bevel gear 246 in FIG. 16) to block the swiveling movement of the brake casters 72, 82, 84. Illustratively, the three brake casters 72, 82, 84 are of the type manufactured by Tente Casters, Inc., Hebron, Ky. 41048, having a part number 2446 UAP 150 R05.

As shown in FIGS. 9-11, the cam 112 has a parallelogram-shaped flange 268 at one end, a circular central portion 270 that extends axially inwardly from the flange 268 and oppositely-disposed top and bottom lobes 272, 274 that project radially outwardly from the central portion 270. As shown in FIG. 9, the cutout 190 in the head end cam plate 182 has a generally trapezoidal configuration having a top edge 280, a bottom edge 282 and side edges 284. The top edge 280 of the cutout 190 has a downwardly-facing notch 286 that is configured to receive the top lobe 272 (FIG. 10) of the cam 112. Likewise, the cutout 220 in the foot end cam plate 184 has a generally trapezoidal configuration having a top edge 290, a bottom edge 292 and side edges 294. The bottom edge 292 of the cutout 220 has an upwardly-facing notch 296 that is configured to receive the bottom lobe 274 (FIG. 11) of the cam 112.

Referring to FIGS. 5-11, upon depressing the brake pedal 124 downwardly, the shaft half 106 rotates in a counterclockwise direction indicated by arrow 300. When the shaft half 106 rotates in the counterclockwise direction 300, the top lobe 272 of the cam 112 received in the downwardly-facing notch 286 in the head end cam plate 182 pushes the head end cam plate 182 (coupled to the link 152) toward the foot end 64 in a direction indicated by arrow 304 and the bottom lobe 274 of the cam 112 received in the upwardly-facing notch 296 in the foot end cam plate 184 pushes the foot end cam plate 184 (coupled to the link 154) toward the head end 62 in a direction indicated by arrow 302. Thus, when the shaft half 106 rotates in the counterclockwise direction 300, the head and foot end links 152, 154 coupled to the head and foot end cam plates 182, 184 are pulled inwardly in longitudinal directions 304, 302, respectively, relative to a transverse axis 76 (FIG. 4) of the base frame 22. The linkage 96 includes a guide plate 320 (FIG. 9) having an outwardly-extending lip 322. The top edges of the cam plates 182, 184 are guided by the downwardly-facing surface of the lip 322 as the cam plates 182, 184 move inwardly in directions 304, 302.

As shown in FIG. 5, when the head end link 152 is pulled inwardly in direction 304, the rocker arm 196 (similar to the rocker arm 226 in FIG. 15) on the left side 66 of the base frame 22 near the head end 62 rotates in a clockwise direction indicated by arrow 306. Rotation of the head end rocker arm 196 in the clockwise direction 306 forces the spring-loaded plunger (similar to the plunger 236 in FIG. 15) of the head end brake caster 72 downwardly, thereby blocking the rotation of the caster wheel (similar to the caster wheel 256 in FIG. 15) about its axis and the swiveling movement of the caster wheel yoke (similar to the caster wheel yoke 242 in FIG. 15) about the plunger housing (similar to the plunger housing 240 in FIG. 15). Likewise, as shown in FIGS. 5 and 15, when the foot end link 154 is pulled inwardly in direction 302, the rocker arm 226 on the left side 66 near the foot end 64 rotates in a counterclockwise direction indicated by arrow 308. Rotation of the foot end rocker arm 226 in the counterclockwise direction 308 forces the spring-loaded plunger 236 of the foot end brake-steer caster 74 downwardly, thereby blocking the rotation and the swiveling movement of the foot end brake-steer caster 74.

On the other hand, as shown in FIGS. 5-11, upon depressing the steer pedal 122 downwardly, the shaft half 106 rotates in a clockwise direction indicated by arrow 310. When the shaft half 106 rotates in the clockwise direction 310, the top lobe 272 of the cam 112 received in the downwardly-facing notch 286 in the head end cam plate 182 pushes the head end cam plate 182 (coupled to the link 152) toward the head end 62 in a direction indicated by arrow 312 and the bottom lobe 274 of the cam 112 received in the upwardly-facing notch 296 in the foot end cam plate 184 pushes the foot end cam plate 184 (coupled to the link 154) toward the foot end 64 in a direction indicated by arrow 314. Thus, when the shaft half 106 rotates in a clockwise direction 310, the links 152, 154 coupled to the inner and outer plates 182, 184 are pushed outwardly in longitudinal directions 312, 314, respectively, relative to the transverse axis 76 (FIG. 4) of the base frame 22. The top edges of the cam plates 182, 184 are guided by the downwardly-facing surface of the lip 322 as the cam plates 182, 184 move outwardly in directions 304, 302.

As shown in FIG. 5, when the head end link 152 is pushed outwardly in direction 312, the rocker arm 196 on the left side 66 of the base frame 22 near the head end 62 rotates in a counterclockwise direction indicated by arrow 316. Rotation of the head end rocker arm 196 in the counterclockwise direction 316 allows the spring-loaded plunger (similar to the plunger 236 shown in FIG. 16) of the head end brake caster 72 to move upwardly. The upward movement of the plunger of the head end brake caster 72 to a position that corresponds to the position of the plunger 236 in FIG. 16 allows the caster wheel (similar to the caster wheel 256 shown in FIG. 16) to rotate freely about its axis and allows the brake caster 72 to swivel freely. As shown in FIGS. 5 and 16, when the foot end link 154 is pushed outwardly in direction 314, the rocker arm 226 on the left side 66 near the foot end 64 rotates in a clockwise direction indicated by arrow 318. Rotation of the foot end rocker arm 226 in the clockwise direction 318 allows the spring-loaded plunger 236 of the foot end brake-steer caster 74 to move upwardly. As a result, the rib 260 on the upperside of the bevel gear 246 engages the downwardly-facing slot 262 of the yoke 242 to block the swiveling movement of the foot end brake-steer caster 74, but not its rotation.

As shown in FIG. 3, on the right side 68 of the base frame 22, the brake-steer linkage 100 includes a pair of links 152, 154 extending toward the head and foot ends 62, 64 of the base frame 22, a cam 112 having top and bottom lobes 272, 274 mounted on the shaft half 108 for rotation therewith, a head end cam plate 182 having a cutout 190 for receiving the cam 112, a foot end cam plate 184 having a cutout 220 for receiving the cam 112, and rocker arms 196, 226 coupled to the respective links 152, 154 on the right side 68 of the base frame 22. When the brake pedal 134 on the right side 68 is depressed, the head and foot end casters 82, 84 are braked in the same manner as the brake caster 72 on the left side 66. When the steer pedal 132 on the right side 68 is depressed, the head and foot end casters 82, 84 are neither braked, nor is their swiveling movement blocked, in the same manner as the brake caster 72 on the left side 66.

The three brake casters 72, 82, 84 are moved into and out of their respective neutral and brake modes in the same manner as the brake-steer caster 74 is moved into and out of its neutral and brake modes. However, when the plunger of a brake caster 72, 82, 84 is in its upwardmost position (similar to the position shown in FIG. 16), the caster wheel yoke of the associated brake caster 72, 82, 84 is still free to swivel with respect to the plunger housing. This is so because the brake casters 72, 82, 84 do not have a plate with a slot therein (similar to the plate 264 with the slot 262 therein as shown in FIG. 16) in which to capture a rib on an upperside of a bevel gear (similar to the rib 260 on the upperside the bevel gear 246 as shown in FIG. 16) to block swiveling movement of the brake casters 72, 82, 84.

Both pedal levers 126, 128 have a generally horizontal position when all four casters 72, 74, 82, 84 are in their respective neutral modes. Downward actuation of either brake pedal 124, 134 beyond the generally horizontal position of the associated pedal lever 126, 128 causes the linkage 100 to position all four casters 72, 74, 82, 84 in their respective brake modes. On the other hand, downward actuation of either steer pedal 122, 132 beyond the generally horizontal position of the associated pedal lever 126, 128 causes the linkage 100 to position the brake-steer caster 74 in the steer mode, while allowing the remaining three brake casters 72, 82, 84 to remain in the neutral mode. When the brake pedals 124, 134 are in their respective brake positions, either one of the steer pedals 122, 132 may be used to return the pedal levers 126, 128 to their respective horizontal positions to, in turn, position all four casters 72, 74, 82, 84 in their respective neutral modes. On the other hand, when the steer pedals 124, 134 are in their respective steer positions, either one of the brake pedals 124, 134 may be used to return the pedal levers 126, 128 to their respective horizontal positions to, in turn, position all four casters 72, 74, 82, 84 in their respective neutral modes.

Referring now to FIGS. 12-13, there is illustrated a detent mechanism 350 for maintaining shaft 104 in the three respective angular positions which correspond the neutral, brake and steer modes of the brake-steer caster 74 and the neutral and brake modes of the three brake casters 72, 82, and 84. The detent mechanism 350 includes a mounting block 352 secured to an access plate 354. The access plate 354 is, in turn, removably mounted to the cross beam 50 from an underside of the cross beam 50 with suitable fasteners, such as screws. The mounting block 352 includes a bore 356 which rotatably supports a collar 358. The collar 358 has a bore 360 which receives the innermost ends of the two shaft halves 106, 108. The innermost ends of the shaft halves 106, 108 are secured to the collar 358 with pins (not shown) to rotatably couple the shaft halves 106, 108 to each other.

The mounting block 352 further houses a longitudinally-shifting plunger 362 which is spring loaded toward the collar 358 with a compression spring 364. The plunger 362 includes a plunger tip 366 which cooperates with three similarly-shaped notches 368, 370, and 372 in the collar 358. The three notches 368, 370 and 372 corresponds to the neutral, brake and steer positions of the pedal levers 126, 128, which positions, in turn, correspond to the neutral, brake and steer modes of the brake-steer caster 74 and the neutral and brake modes of the brake casters 72, 82, 84. When the brake-steer caster 74 is moved from the neutral mode to the steer mode, the brake casters 72, 82, 84 continue remain in the neutral mode. The centermost notch 368 corresponds to the neutral mode. The notch 370 corresponds to the brake mode. The notch 372 corresponds to the steer mode.

The mounting block 352 includes a V-shaped notch 374 therein having ends 376, 378 which serve as stops for a stop pin 380 pressed into the collar 358 on the side of the collar 358 facing the V-shaped notch 374. In use, one of the pedal levers 126, 128 will normally be positioned in a horizontal position thus placing the brake-steer caster 74, as well as the three brake casters 72, 82, 84, in their respective neutral modes, thereby allowing the casters 72, 74, 82, 84 to swivel freely relative to their respective housings (not shown) and allowing the caster wheels of the casters 72, 74, 82, 84 to rotate freely about their respective rotational axes. The pedal levers 126, 128 are maintained in the horizontal position by the compression spring 364 which forces the plunger tip 366 into the centermost notch 368 in the collar 358.

Pressing one of the steer pedals 122, 132 downwardly causes each of the four rocker arms 196, 226 to rotate away from respective spring-loaded plungers, allowing the plungers to move upwardly. As the caster 74 is a brake-steer caster, the caster 74 is prevented from swiveling while the brake casters 72, 82, 84, being simply brake casters, are allowed to swivel freely. The pedal levers 126, 128 are maintained in the respective steer positions by the compression spring 364 which forces the plunger tip 366 into the notch 372 in the collar 358. Over travel of the pedal levers 126, 128, the shaft halves 106, 108, and the collar 358 is prevented by the stop pin 380 received in the V-shaped notch 374 in the mounting block 352.

To take the bed 20 out of its steer mode and to activate the brake mode of the casters 72, 74, 82, and 84, to, for example, park the bed 20, one of the brake pedals 124, 134 is depressed through the middle neutral position to the brake position. All four rocker arms 196, 226 force the associated spring-loaded plungers downwardly to block the rotation, as well as the swiveling movement, of the casters 72, 74, 82, and 84. The pedal levers 126, 128 are maintained in their respective brake positions by the compression spring 364 which forces the plunger tip 366 into the notch 370 in the collar 358. Over travel of the pedal levers 126, 128, the shaft halves 106, 108, and the collar 358 is prevented by the stop pin 380 received in the V-shaped notch 374 in the block 352.

Although certain illustrative embodiments have been described in detail above, variations and modifications exist within the scope and spirit of this disclosure as described and as defined in the following claims.

The invention claimed is:

1. A patient support apparatus comprising:

a base having a first side, a second side, a head end, and a foot end, a head end caster and a foot end caster coupled to the base on the first side near the respective head and foot ends, wherein one of the two casters is a brake-steer caster having neutral, brake and steer modes and the other of the two casters is a brake caster having neutral and brake modes, a head end link and a foot end link located on the first side and operably associated with the respective head and foot end casters on the first side, the head and foot end links on the first side moving longitudinally in a first pair of opposite directions to brake the respective head and foot end casters on the first side, and the head and foot end links on the first side moving longitudinally a second pair of opposite directions to prevent swiveling of the steer caster, a shaft pivotably mounted to the base and carrying a pedal lever including brake and steer pedals, and a linkage coupling the shaft to the head and foot end links, the linkage comprising a cam mounted on the shaft for rotation therewith, a head end cam plate, and a foot end cam plate; the head and foot end cam plates configured to operatively engage the cam and the head and foot end cam plates coupled to the respective head and foot end links so that downward actuation of the brake pedal causes the cam to push the two cam plates in the first pair of opposite directions to brake the two casters and so that downward actuation of the steer pedal causes the cam to push the two cam plates in the second pair of opposite directions to prevent swiveling of the steer caster.

2. The apparatus of claim 1, wherein the head end link moves toward the foot end of the base and the foot end link moves toward the head end of the base when the two cam plates are pushed in the first pair of opposite directions.

3. The apparatus of claim 2, further comprising a pin secured to the shaft and a rotational stop secured to the base, wherein the pin engages the rotational stop to limit the rotation of the shaft in a braking direction in response to the downward actuation of the brake pedal.

4. The apparatus of claim 1, wherein the pedal lever has a generally horizontal position when the two casters are in their respective neutral modes.

5. The apparatus of claim 1, wherein the pedal lever brake and steer pedals are arranged on opposite sides of the shaft, the pedal lever has a generally horizontal position when the two casters are in their respective neutral modes.

6. The apparatus of claim 5, further comprising a pin secured to the shaft and first and second rotational stops secured to the base, wherein the pin engages the first rotational stop to limit the rotation of the shaft in a braking direction in response to the downward actuation of the brake pedal and the pin engages the second rotational stop to limit the rotation of the shaft in a steering direction in response to the downward actuation of the steer pedal.

7. The apparatus of claim 5, wherein the base has a first longitudinally-extending rail on the first side, a second longitudinally-extending rail on the second side and a cross beam interconnecting the two rails, the two links on the first side are located within an interior region of the first rail, and the shaft is located within an interior region of the cross beam.

8. The apparatus of claim 5, wherein the first side comprises a first rail and the cam and the cam plates are located within the interior region of the first rail.

9. The apparatus of claim 8, wherein the linkage further comprises a head end rocker arm pivotally coupled to the first rail near the head end, a first end of the head end rocker arm is adapted to actuate the head end caster, a second end of the head end rocker arm is coupled to a first end of the head end link, and a second end of the head end link is coupled to the head end cam plate, and the linkage further comprises a foot end rocker arm pivotally coupled to the first rail near the foot end, a first end of the foot end rocker arm is adapted to actuate the foot end caster, a second end of the foot end rocker arm is coupled to a first end of the foot end link, and a second end of the foot end link is coupled to the foot end cam plate.

10. The apparatus of claim 5, wherein the linkage further includes a detent mechanism operable to resist the rotation of the shaft when the shaft is in angular positions that correspond to the neutral, brake and steer modes of the brake-steer caster.

11. The apparatus of claim 10, wherein the detent mechanism comprises a block coupled to the base and having a bore to rotatably support the shaft, a plunger slidably mounted in the block and biased forward so as to project into the bore, and a plurality of recesses around the circumference of the shaft, each of the recesses corresponding to one of the neutral, brake and steer modes of the brake-steer caster.

12. A patient support apparatus comprising:

an elongated base, a plurality of casters coupled to the base and including at least one caster having an upwardly-biased plunger which is actuable to provide a neutral mode and a brake mode, and a linkage coupled to the base and operable to actuate the upwardly-biased plunger to position the at least one caster in the neutral and brake modes, the linkage including a shaft mounted to the base for pivoting movement about a transverse axis, a cam mounted on the shaft for rotation therewith, and a cam plate configured to be bi-directionally pushed by the cam so that pivoting movement of the shaft in braking and steering directions causes longitudinal movement of the cam plate in respective braking and steering directions independently of the upwardly-biased plunger.

13. The apparatus of claim 12, wherein the shaft carries a brake pedal, and downward actuation of the brake pedal causes the shaft to rotate in the braking direction to position the at least one caster in the brake mode.

14. The apparatus of claim 13, wherein the linkage further comprises a pin secured to the shaft and a rotational stop secured to the base, wherein the pin engages the rotational stop to limit the rotation of the shaft in the braking direction in response to the downward actuation of the brake pedal.

15. The apparatus of claim 12, wherein the shaft carries a pedal lever, the at least one caster has a steer mode in addition to the neutral and brake modes, the pedal lever has brake and steer pedals on opposite sides of the shaft, the pedal lever has a generally horizontal position when the at least one caster is in the neutral mode, downward actuation of the brake pedal beyond the generally horizontal position causes the linkage to position the at least one caster in the brake mode, and downward actuation of the steer pedal beyond the generally horizontal position causes the linkage to position the at least one caster in the steer mode.

16. The apparatus of claim 15, wherein the linkage further comprises a pin secured to the shaft and first and second rotational stops secured to the base, wherein the pin engages the first rotational stop to limit the rotation of the shaft in the braking direction in response to the downward actuation of the brake pedal and the pin engages the second rotational stop to limit the rotation of the shaft in the steering direction in response to the downward actuation of the steer pedal.

17. The apparatus of claim 15, wherein the linkage further comprises a detent mechanism operable to resist the rotation of the shaft when the shaft is in angular positions corresponding to the neutral and brake modes of the at least one caster.

18. The apparatus of claim 12, wherein the linkage further comprises a rocker arm operably associated with the at least one caster and a link associated with the rocker arm, the rocker arm is pivotally mounted to the base, a first end of the rocker arm is adapted to actuate the at least one caster, a second end of the rocker arm is coupled to a first end of the link, and a second end of the link is coupled to the cam plate.

19. A patient support apparatus comprising:

a base having a first side, a second side, a head end, and a foot end, a head end caster and a foot end caster coupled to the base on the first side near the respective head and foot ends, head end and foot end cam plates located on the first side and operably associated with the respective head and foot end casters on the first side, the head and foot end cam plates on the first side moving longitudinally in opposite directions to brake the respective head and foot end casters on the first side, and a shaft pivotably mounted to the base and a cam configured to bi-directionally push the cam plates, wherein the cam is mounted on the shaft for rotation therewith.

20. The apparatus of claim 19, wherein rotation of the shaft in a braking direction causes the head and foot end cam plates to move in opposite directions to brake the two casters.

21. The apparatus of claim 20, wherein the head and foot end cam plates move away from the respective head and foot end casters to brake the two casters.

22. The apparatus of claim 20, wherein rotation of the shaft in a steering direction causes the head and foot end cam plates to move in opposite directions to unbrake the two casters.

23. The apparatus of claim 22, wherein the head and foot end cam plates move toward the respective head and foot end casters to unbrake the two casters.

24. The apparatus of claim 22, wherein the shaft carries a pedal lever, the pedal lever has brake and steer pedals on opposite sides of the shaft so that downward actuation of the brake pedal rotates the shaft in the braking direction to brake the two casters and downward actuation of the steer pedal rotates the cam in the steering direction to unbrake the two casters.

25. The apparatus of claim 24, wherein the pedal lever is mounted outboard of the cam.

26. The apparatus of claim 19, wherein one of the two casters is a brake-steer caster having neutral, brake and steer modes and the other of the two casters is a brake caster having neutral and brake modes, the pedal lever has brake and steer pedals on opposite sides of the shaft, the pedal lever has a generally horizontal position when the two casters are in their respective neutral modes, downward actuation of the brake pedal beyond the generally horizontal position causes the cam plates to position the two casters in their respective brake modes, and downward actuation of the steer pedal beyond the generally horizontal position causes the cam plates to position the brake-steer caster in the steer mode while allowing the brake caster to remain in the neutral mode.

27. The apparatus of claim 26, further comprising a pin secured to the shaft and first and second rotational stops secured to the base, wherein the pin engages the first rotational stop to limit the rotation of the shaft in a braking direction in response to the downward actuation of the brake pedal and the pin engages the second rotational stop to limit the rotation of the shaft in a steering direction in response to the downward actuation of the steer pedal.

* * * * *